US010035029B2

(12) United States Patent
Dawson

(10) Patent No.: US 10,035,029 B2
(45) Date of Patent: Jul. 31, 2018

(54) FALL ARREST HARNESS

(75) Inventor: Brian Dawson, Antrim (GB)

(73) Assignee: CHECKMATE LIMITED, Kent (GB)

( * ) Notice: Subject to any disclaimer, the term of this patent is extended or adjusted under 35 U.S.C. 154(b) by 1645 days.

(21) Appl. No.: 12/518,608

(22) PCT Filed: Dec. 11, 2006

(86) PCT No.: PCT/GB2006/004621
§ 371 (c)(1),
(2), (4) Date: Jun. 10, 2009

(87) PCT Pub. No.: WO2007/068899
PCT Pub. Date: Jun. 21, 2007

(65) Prior Publication Data

US 2010/0025148 A1 Feb. 4, 2010

(30) Foreign Application Priority Data

Dec. 13, 2005 (GB) ..... 0525386.9

(51) Int. Cl.
*A62B 35/00* (2006.01)
*A62B 35/04* (2006.01)

(52) U.S. Cl.
CPC ..... *A62B 35/0018* (2013.01); *A62B 35/0012* (2013.01); *A62B 35/04* (2013.01)

(58) Field of Classification Search
CPC ..... A62B 35/04
(Continued)

(56) References Cited

U.S. PATENT DOCUMENTS 289,924 A * 12/1883 Morris ..... E06C 1/381 182/100
2,448,066 A * 8/1948 Wilson ..... B64D 17/30 182/3

(Continued)

FOREIGN PATENT DOCUMENTS

EP 0 508 278 A1 10/1992
EP 0508278 A1 * 10/1992 ..... A62B 35/0018

(Continued)

OTHER PUBLICATIONS

International Search Report for International Application No. PCT/GB2006/004621 (dated Apr. 26, 2007).

*Primary Examiner* — Katherine W Mitchell
*Assistant Examiner* — Candace L Bradford
(74) *Attorney, Agent, or Firm* — Jenkins, Wilson, Taylor & Hunt, P.A.

(57) ABSTRACT

A fall arrest harness comprises a pair of shoulder straps, a pair of leg straps and a rear section extending therebetween, a lanyard connection member being connected to a sternal or chest region of the shoulder straps, the rear section defining a seat portion, adapted to lie across the sub-pelvic region or seat of the wearer, and a back portion, adapted to overlie at least a portion of the back of the wearer, the shoulder straps extending between side regions of the seat portion, preferably adjacent a lower edge thereof, and an upper region of the back portion, whereby the wearer, when suspended in the harness by the lanyard connection member, lies in a supine position with the weight of the wearer supported by the seat portion and back portion of the rear section and the shoulder straps with no load being borne by the leg straps.

13 Claims, 5 Drawing Sheets

(58) Field of Classification Search
USPC ..... 182/3, 7; 244/151 R, 142; 119/857
See application file for complete search history.

(56) References Cited

U.S. PATENT DOCUMENTS 2,462,234 A * 2/1949 Supina ..... B64D 17/30 244/151 R
3,302,973 A * 2/1967 Ravau ..... B60R 22/16 244/151 R
3,747,528 A * 7/1973 Harkness ..... F42B 4/28 102/339
4,047,255 A * 9/1977 Kiefer ..... B63C 9/115 114/39.18
4,347,914 A * 9/1982 Gary ..... A45F 3/26 182/142
4,512,437 A * 4/1985 Savage ..... A62B 35/0018 119/857
4,598,792 A * 7/1986 Lew ..... A62B 1/00 182/42
4,687,074 A * 8/1987 Green ..... A45F 3/26 182/3
5,080,191 A * 1/1992 Sanchez ..... A47D 13/086 182/3
5,228,412 A 7/1993 Bell
5,360,082 A * 11/1994 Bell ..... A62B 1/06 182/3
5,433,289 A * 7/1995 O'Rourke ..... A62B 35/0018 182/3
5,878,833 A * 3/1999 Bell ..... A62B 1/14 182/192
6,223,854 B1 * 5/2001 Nolz ..... A41D 13/0007 182/133
6,374,946 B1 * 4/2002 Petzl ..... A62B 35/0018 182/3
6,447,353 B1 * 9/2002 Henry ..... B63C 9/115 441/106
6,581,725 B2 * 6/2003 Choate ..... A62B 35/0056 182/3
6,874,596 B2 * 4/2005 Zeissler ..... A62B 35/00 182/3
D556,383 S * 11/2007 Petzl ..... D29/101.1
8,528,866 B2 * 9/2013 Fradet ..... B64D 17/30 244/147
2005/0005343 A1 * 1/2005 Johnson ..... F41H 1/02 2/102
2006/0054387 A1 * 3/2006 Fortin ..... A62B 35/0018 182/3
2006/0113147 A1 * 6/2006 Harris, Jr. ..... A62B 35/0093 182/3
2007/0023231 A1 * 2/2007 Gorman ..... A62B 35/0018 182/3
2007/0107109 A1 * 5/2007 Johnson ..... F41H 1/02 2/102
2007/0272484 A1 * 11/2007 Helms ..... A62B 35/0018 182/3
2011/0017546 A1 * 1/2011 Nichols, Jr. ..... A62B 35/0018 182/3
2012/0174286 A1 * 7/2012 McBride ..... F41H 1/02 2/102
2014/0008147 A1 * 1/2014 Jones ..... A62B 35/0018 182/3

FOREIGN PATENT DOCUMENTS

FR 2 397 846 2/1979
FR 2 705 244 A1 11/1994
FR 2 743 303 A1 7/1997
WO WO 02/074389 A2 9/2002

* cited by examiner

FALL ARREST HARNESS

The present invention relates to a fall arrest harness for persons working at height, and in particular a fall arrest harness for reducing the risk of suspension trauma.

The Work at Height Regulations 2005 place a duty on all employers to do all that is practicable to prevent falls where employees must work at height where there is a risk of a fall liable to cause personal injury.

This duty requires persons working at height where there is a risk of a fall to wear a fall arrest or safety harness attached by a lanyard to a fixed point whereby, should a fall occur, the fall is arrested before the person hits the ground. A typical fall arrest harness includes leg straps arranged to encircle the wearer's thighs, and a pair of shoulder straps extending over the wearer's shoulders, and a lanyard connection member, usually in the form of a D-ring, for connecting the harness to a lanyard.

In order to minimise interference with the work being carried out and to minimise the risk of injury during fall arrest in a typical feet first fall, the lanyard connection member is usually provided in a dorsal position, on the wearer's back above the wearer's centre of gravity substantially level with the shoulder blades, such that the wearer is suspended in a substantially vertical, feet-down, head-up position. Indeed most legislation governing fall arrest harness design requires a dorsal lanyard connection, or at least an attachment point positioned to cause the wearer to be suspended in a head-up position inclined to the vertical by no more than 50° (such as standard EN 361 in the United Kingdom).

However, suspension of a person by a fall arrest harness for more than a few minutes, particularly when the person is unconscious, can cause serious injury and even death due to what has become known as suspension trauma or suspension induced pathology. This is believed to be caused by the pooling of blood in the suspended person's legs (known as venous pooling) and is particularly aggravated by the leg loops or straps concentrating pressure at the inside thigh and/or groin area and causing restriction of the venous system in the legs, encouraging venous pooling and the onset of suspension trauma. Such venous pooling starves the brain and other organs, such as the liver, of oxygen, leading to orthostatic shock and ultimately death. Such suspension trauma can become fatal with known fall arrest harnesses within twenty minutes of immobile suspension and thus it is vital to rescue the suspended person as quickly as possible. When the fall occurs in an inaccessible location, it is often difficult to reach the person quickly enough, leading to a real risk of death due to suspension trauma.

An object of the present invention is to provide a fall arrest harness that avoids or at least greatly delays the onset of suspension trauma.

According to the present invention there is provided a fall arrest harness comprising a pair of shoulder straps, a pair of leg straps and a rear section extending therebetween, a lanyard connection member being connected to a sternal or chest region of the shoulder straps, the rear section defining a seat portion, adapted to lie across the sub-pelvic region or seat of the wearer, and a back portion, adapted to overlie at least a portion of the back of the wearer, the shoulder straps extending between side regions of the seat portion, preferably adjacent a lower edge thereof, and an upper region of the back portion, whereby the wearer, when suspended in the harness by the lanyard connection member, lies in a supine position with the weight of the wearer supported by the seat portion and back portion of the rear section and the shoulder straps with no load being borne by the leg straps.

By suspending the wearer in a supine position, with the weight of the wearer spread across the seat portion and back portion of the rear section and borne by the shoulder straps with no load being borne by the leg straps, the restriction of the venous system in the legs due to the concentration of pressure at the inside thigh and/or groin area caused by the leg loops or straps is thus avoided. Furthermore, the lanyard connection member is accessible to the wearer in front of the wearer's body, making it possible for the wearer to pull themselves back up the lanyard using an ascender device.

Preferably further strap portions extend between side regions of the back portion of the rear section and the shoulder straps.

Preferably the lanyard connection member is connected to the sternal region of the shoulder straps via one or more extension straps, the lanyard connection member being releasably attachable to the back portion of the rear section at a dorsal position by releasable securing means whereby the lanyard connection member is detached from the back portion when a tensile force applied to the lanyard connection member exceeds a predetermined threshold such that the lanyard connection member separates from the back portion in the event of a fall. Thus the lanyard connection member is located in a convenient dorsal position during normal movement of the wearer, preventing the lanyard from interfering with work operations carried out by the wearer, but automatically moved to a sternal suspension position in the event of a fall to suspend the user in the desired position with the wearer's weight supported by the rear section and the shoulder straps.

In order to absorb some of the force applied to the wearer due to the sudden deceleration caused by the harness and lanyard when a fall is arrested, at least a portion of the one or more extension straps may be formed from an energy absorbing material. Preferably said energy absorbing portion comprises a region capable of irreversible elongation under the action of a tensile force.

Preferably at least a portion of the one or more extension straps is detachably retained in contact with the shoulder straps and/or the back portion of the rear section by separable or releasable securing means to slow and control the detachment of the one or more extension straps from the shoulder straps and/or the back portion and thus to control the release of the lanyard connection member from its dorsal position to its extended sternal suspension position in the event of a fall to absorb the energy of the fall and to control and guide the movement of the wearer towards the suspended, supine position.

The separable or releasable securing means of the lanyard connection member and/or the one or more extension straps may comprise preferentially tearable securing means, such as tearable stitching, or hook and loop fastening means attached respectively to the lanyard connection member and/or the one or more extension straps and the regions of the shoulder straps and/or rear section to which they are releasably attached. However, it is envisaged that other forms of separable or releasable securing means may be used for the lanyard connection member and/or the one or more extension straps, such as preferentially releasable adhesive or press stud fasteners or similar.

In a preferred embodiment the rear section comprises a single panel to which the shoulder straps and leg straps are connected. Thus the weight of the wearer is spread evenly across the wearer's seat and back and the risk of the wearer falling out of the harness is obviated. The length of the rear section may be adjustable to suit the body length of the wearer. In one embodiment the length of the rear section may automatically increase during the shock of a fall, preferably by virtue of similar releasable securing means as those used for the lanyard connection and/or one or more extension straps to allow the wearer to sit deeper into the rear section when in the suspended position to further relax any residual tension on the leg straps.

In one embodiment, the shoulder straps comprise a first shoulder strap extending from the back portion of the rear section to one side portion of the seat portion adjacent the lower edge thereof and a second shoulder strap extending from the back portion of the rear section to an opposite side portion of the seat portion the lower edge thereof, first and second extension straps being provided, the first extension strap extending from a sternal region of the first shoulder strap and being provided with releasable fastening means, such as preferentially tearable securing means, such as stitching, or hook an loop fastening material, such that the first extension strap can be releasably secured in contact with the first shoulder strap and a portion of the rear section, the second extension strap extending from a sternal region of the second shoulder strap and being provided with releasable fastening means, such as preferentially tearable securing means, such as stitching, or hook an loop fastening material, such that the second extension strap can be releasably secured in contact with the second shoulder strap and a portion of the rear section, whereby the first and second extension straps can be attached to the first and second shoulder straps and the rear section in a stowed position, the distal ends of the first and second extension straps being connected to a lanyard connection member, such as a D-ring.

The lanyard connection member is preferably located in a dorsal position on the back portion or the rear section when the first and second extension straps are located in their stowed positions in contact with the first and second shoulder straps and the rear section.

A further separable or releasable securing means may be provided for securing the lanyard connection member to the rear section, such as a flap insertable through the lanyard connection member and secured at one end to the rear section in said dorsal position and provided with releasable fastening means, such as hook and loop fastening means, for securing the flap.

Preferably the regions of the first and second extension straps overlying and attached to the rear section are covered by a cover member, such as a flap, releasably secured to the rear section, for example by means of hook and loop fastening means.

In order to further delay and control the release of the extension straps from their stowed positions in contact with the shoulder straps, each of the first and second shoulder straps may be provided with a cover flap adapted to cover a portion of the respective extension strap in contact with the respective shoulder strap, said flap being securable to said portion of the respective extension strap by means of a releasable fastener, such as hook and loop fastening means.

Preferably the leg straps extend between side regions of the seat portion of the rear section and a central region of the seat portion.

The seat portion of the rear section may define a pocket within which can be received a foam seat panel or padding to provide improved support for the seat region of the wearer and enhanced comfort. The seat panel may be formed from a rigid material to provide enhanced support for the wearer and facilitate use of the harness for longer periods of suspension.

One or more further strap portions may be provided extending between the shoulder straps to extend across the chest of the wearer to prevent migration of the shoulder straps off the shoulders of the wearer during normal movement of the wearer. At least one of said one or more further strap portions may be elasticated to avoid restricting the movement of the wearer. Each of said one or more further strap portions may be provided with a separable fastening means, such as a buckle, to permit the harness to be taken on and off. Similarly, one or each of the leg straps and shoulder straps may be include separable fastening means and may be adjustable in length to enable the harness to be fitted to the wearer's body, as is commonly provided in known fall arrest harnesses.

The shoulder straps may comprise continuous strap members extending along and through the length of the rear section.

An embodiment of the present invention will now be described, by way of example only, with reference to the accompanying drawings, in which:—

Figure 1:
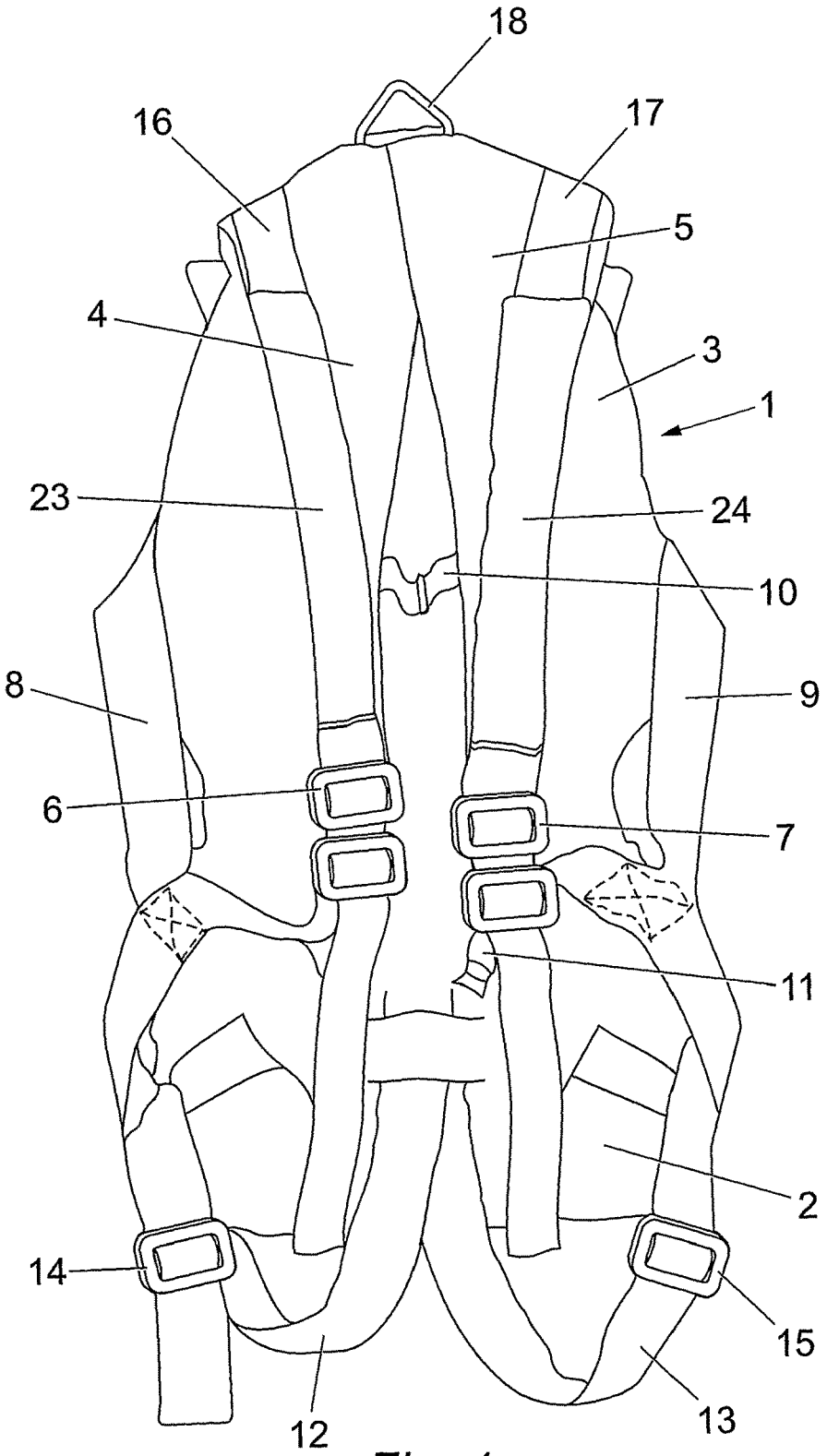
FIG. 1 is a front view of a fall arrest harness according to an embodiment of the present invention showing the lanyard attachment member in its stowed configuration.
Figure 2:
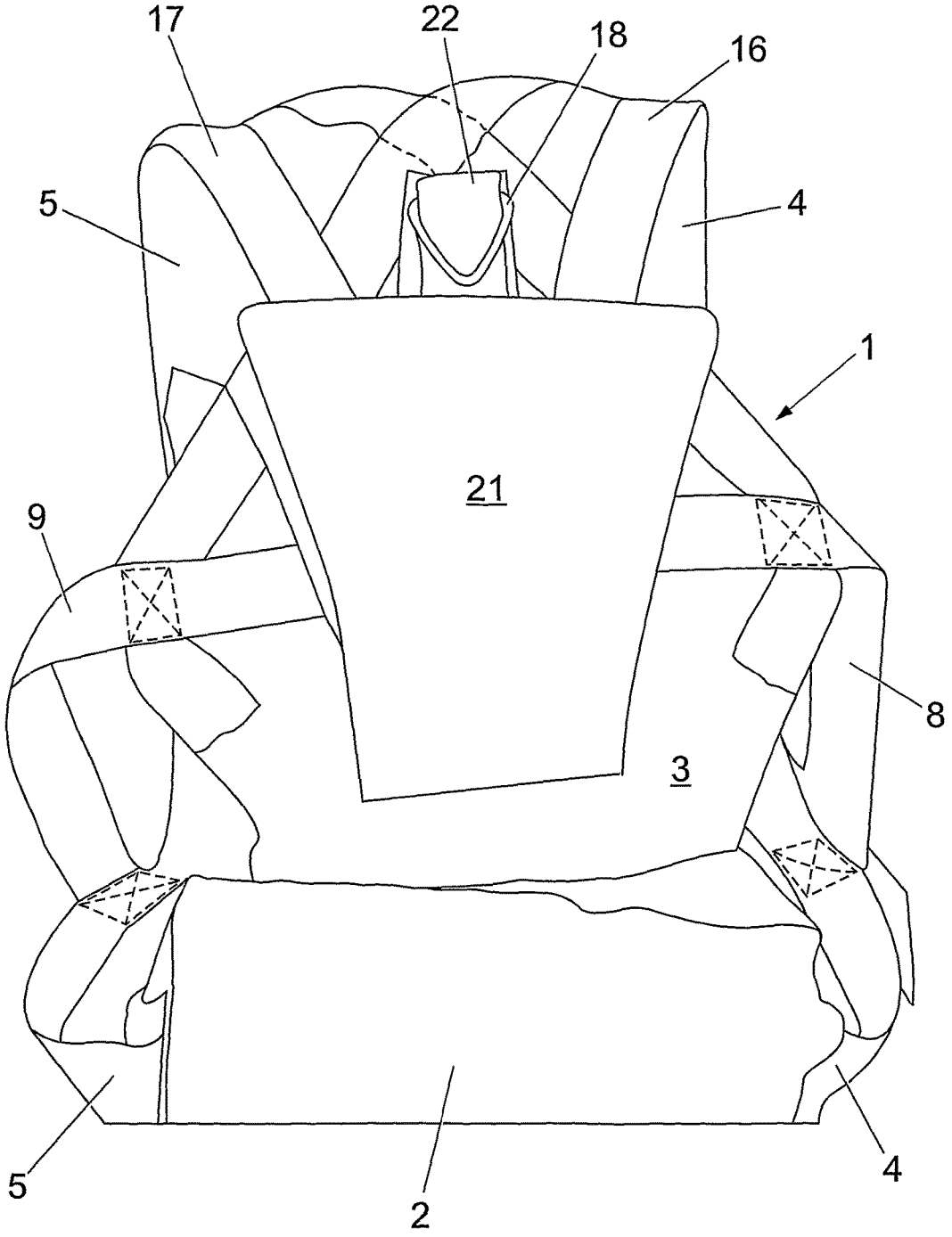
FIG. 2 is a rear view of the fall arrest harness of FIG. 1.
Figure 3:
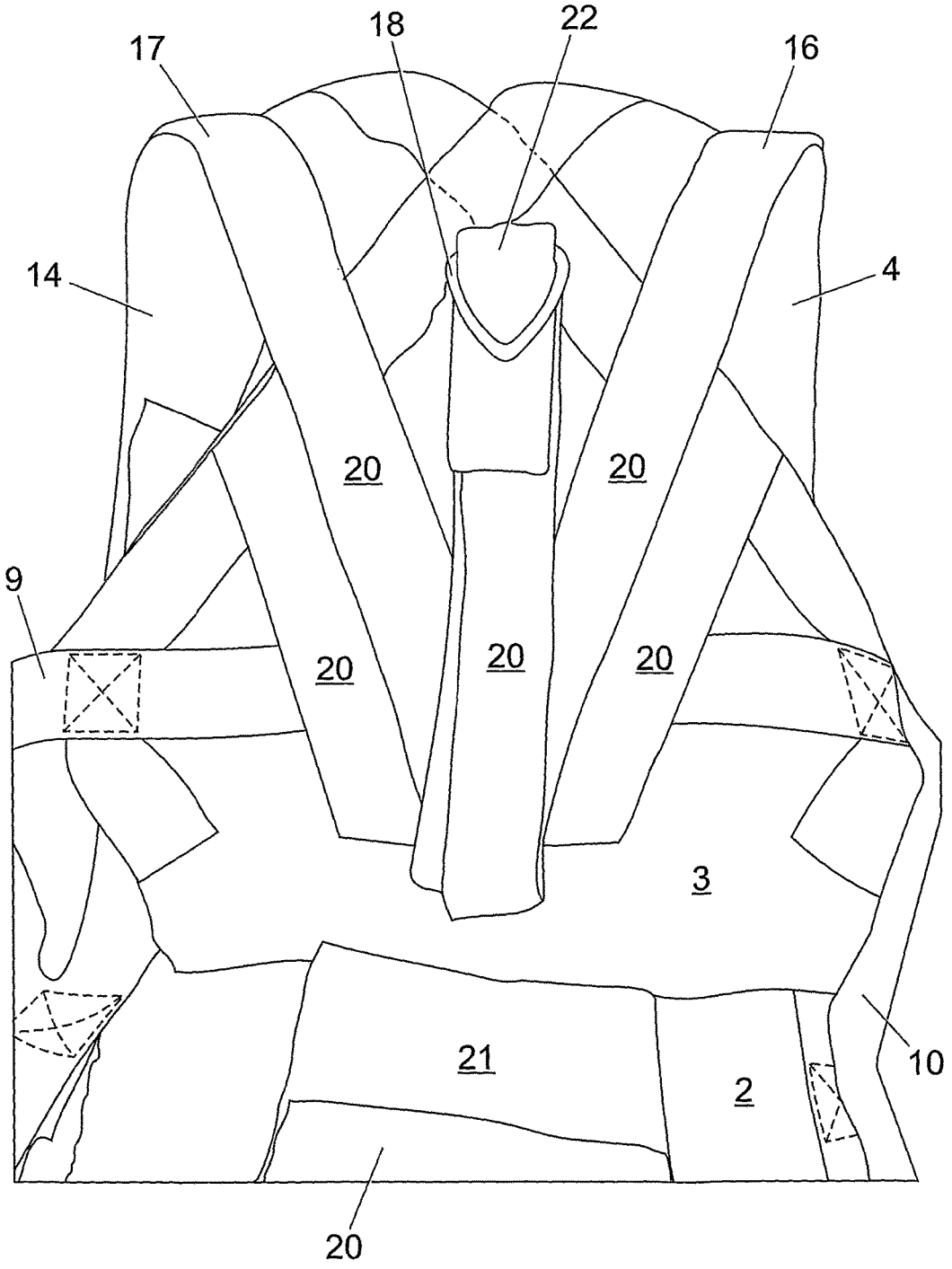
FIG. 3 is a rear view of the fall arrest harness of FIG. 1 with the cover flap detached showing the extension straps in their stowed configuration.
Figure 4:
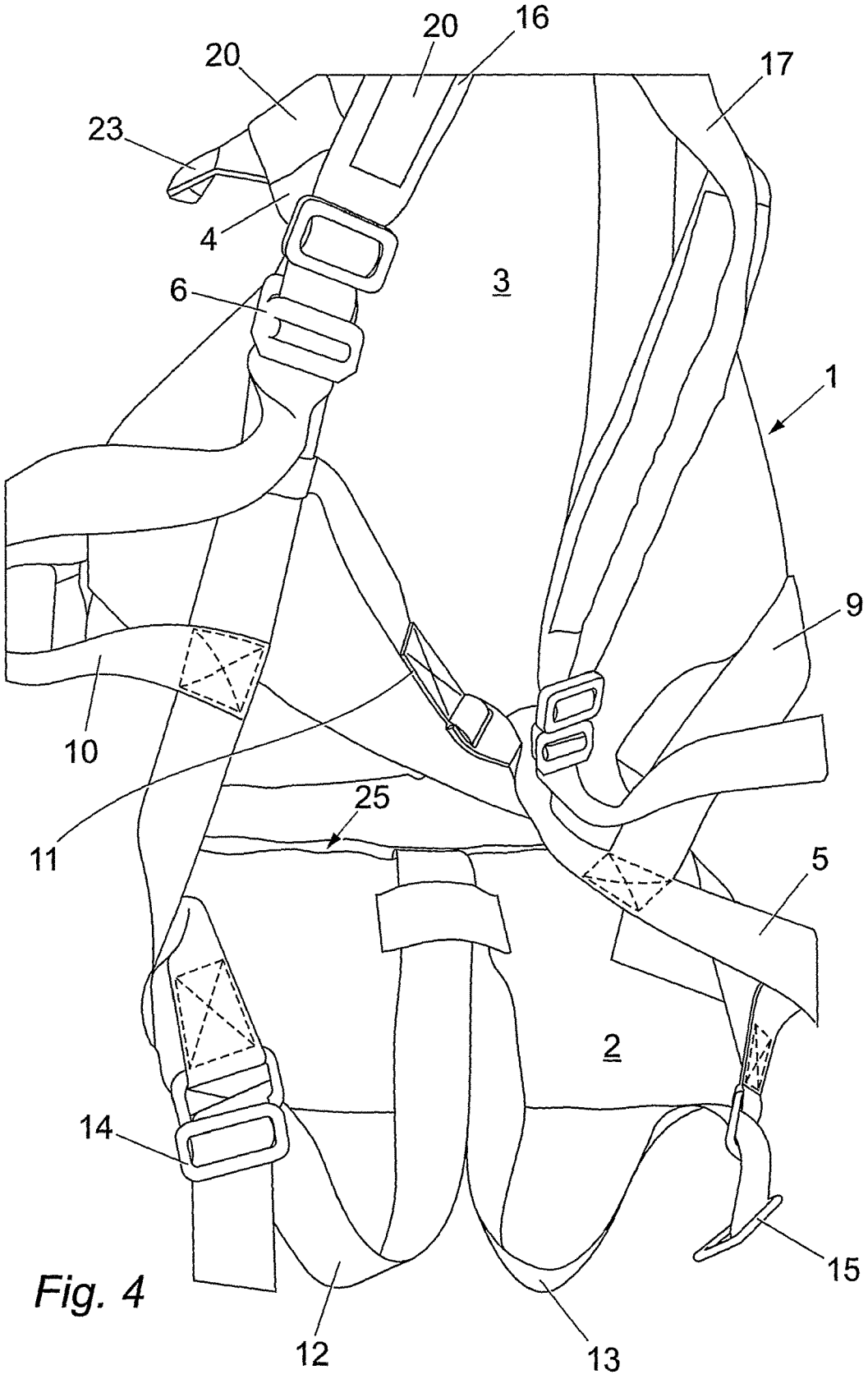
FIG. 4 is a perspective view of the harness of FIG. 1 with the extension straps and lanyard connection member in their suspended configuration, separated from the shoulder straps and back portion.

As shown in the drawings, a fall arrest harness according to a preferred embodiment of the present invention comprises a main panel 1 formed from a textile material to which a plurality of strap means are secured by stitching. The main panel defines a seat portion 2 adapted to overlie the seat or sub-pelvic region of the wearer and a back portion 3 adapted to overlie the back of the wearer. A pair of shoulder straps 4,5 extend between the top of the back portion 3 and the side regions of the seat portion 2 adjacent the lower edge of the seat portion 2. The shoulder straps 4,5 are provided with a buckle arrangement 6,7 to permit each shoulder straps 4,5 to be uncoupled to fit the harness to a wearer and to permit the length of each shoulder strap 4,5 to be varied to obtain the required fit. Such buckle arrangements are well known in harness construction and need not be described in more detail.

A pair of side straps 8,9 extend between side regions of the back portion 3 and lower regions of respective shoulder straps 4,5 to prevent a wearer from falling out of the sides of the harness.

First and second cross straps 10,11 having releasable connectors therein extend between the shoulder straps 4,5 across the torso of the wearer to prevent the shoulder straps 4,5 from migrating off the wearer's shoulders during normal movement. For added comfort the upper, and possibly also the lower, cross strap 10,11 may be formed from an elastic material.

A pair of leg straps 12,13 are attached to the seat portion 2 extending between side regions of the seat portion 2 and a central region of the seat portion 2. Each leg strap 12,13 is provided with a buckle arrangement 14,15 to permit the leg straps 12,13 to be uncoupled to fit the harness to a wearer and to permit the length of the leg straps 12,13 to be varied to obtain the required fit. Unlike known fall arrest harnesses, the leg straps 12,13 are merely intended to locate the harness on the wearer and form no part in the load bearing function of the harness when a person is suspended from the harness, as will be described below.

A pair of elongate extension straps 16,17 extend from upper portions of the shoulder straps 4,5 from a position adjacent the buckles 6,7, such position being level with the chest of the wearer in use. The distal ends of the extension straps 16,17 terminate in a lanyard connection member 18 in the form a triangular metal loop or D-ring for the attachment of a lanyard.

The extension straps 16,17 and the upper regions of the shoulder straps 4,5 are releasably secured to the shoulder straps 4,5 in a stowed configuration by means of tearable securing means, such as preferentially tearable stitching or portions of hook and loop fastening material 20 (such as that sold under the Registered Trade Mark "Velcro"). When in such stowed configuration, the extension straps 16,17 extend onto the back portion 3 of the main panel 1 and are secured thereto by the tearable securing means 20, whereby the lanyard connection member 18 is located at a dorsal position such that the lanyard connected thereto does not interfere with the work being carried out by the wearer.

A cover flap 21 is provided, attached at one end to the back portion of the main panel, said cover flap 21 being releasably secured to said extension straps 16,17 and or back portion 3. A further retention flap 22 provided with hook and loop fastening material 20 is located on the back portion 3 to extend through the lanyard connection member 18 to hold the lanyard connection member 18 in the desired dorsal location during the normal activities of the wearer.

Thus the harness may be comfortably worn during the normal working activities of the wearer whilst connected to a safety lanyard without interfering in the movement or activities of the wearer.

Figure 5:
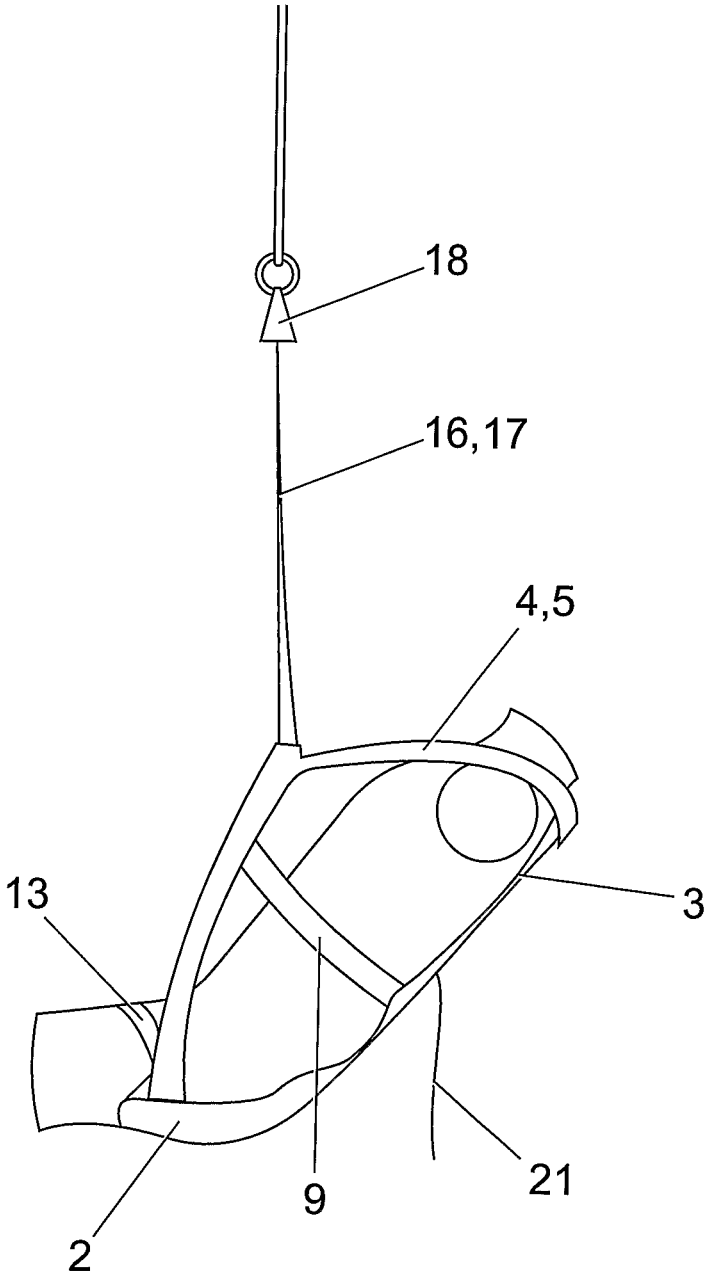
FIG. 5 is a side view of the fall arrest harness of FIG. 1 in use in its suspended configuration.

In the event of a fall, the tension applied to the lanyard connection member 18 by the lanyard causes the lanyard connection member 18 and the associated extension straps 16,17 to gradually separate from the back panel 3 and the shoulder straps 4,5 until the extension straps 16,17 and lanyard connection member 18 reach a suspended configuration, as shown in FIG. 5, wherein the wearer is suspended in a supine position with the weight of the wearer borne by the seat portion 2 and back portion 3 of the main panel 1 and transferred to the lanyard connection member 18 via the shoulder straps 4,5 and the extension straps 16,17.

Because the wearer is suspended in a supine position with the wearer's weight supported by the broad main panel 1, no weight is transferred through the leg straps 12,13 and thus no pressure is placed on the inside thigh and/or groin area, as occurs in prior art harnesses where leg straps are used to support the weight of the wearer. Thus the venous system of the legs is not restricted and the onset of suspension trauma is greatly delayed, or even avoided.

Furthermore, the spreading of the wearer's weight over the area of the main panel 1 avoids pressure concentrations that occur with prior art strap arrangements and, combined with the supine position, provide greater comfort and reduced stress for the wearer when suspended by the lanyard connection member 18 of the harness.

The use of tearable securing means 20 on the extension straps 16,17, cover flap 21 and retention flap 22, and in particular the releasable attachment of the extension straps 16,17 to the shoulder straps 4,5 and back portion 3 over substantially the entire length of the extension straps 16,17, effectively absorbs the shock of the initial arrest of the fall by the lanyard.

Furthermore, the strength of the tearable securing means 20 can be optimised to provide a gradual guided release of the extension straps 16,17 and lanyard connection portion 18 between its stowed and suspended configurations and thus a controlled and guided movement of the wearer between uncontrolled fall and the supine suspended position.

To provide further resistance to the separation of the extension straps 16,17 from the shoulder straps 4,5 during the final separation of the extension straps 16,17 from the shoulder straps 4,5, cover flaps 23,24 may be provided on the shoulder straps 4,5 adapted to overlie the extension straps 16,17, the cover flaps 23,24 being provided with hook and loop fastening material 20 to releasably secure the cover flaps 23,24 to the extension straps 16,17.

To further absorb the decelerative force applied to the wearer by the harness in the event of a fall, the extension straps 16,17 are formed from an energy absorbing material whereby the straps are adapted to deform or partially tear or include weakly stitched separable regions such that the straps irreversibly elongate when exposed to a tensile force beyond a predetermined level.

To further increase the comfort of the wearer when suspended by the harness, the set portion 2 may be provided with a pocket 25 within which can be located a padded seat panel formed, for example, from a closed cell polymeric foam material.

Various modifications and variations to the described embodiments of the inventions will be apparent to those skilled in the art without departing from the scope of the invention as defined in the appended claims. Although the invention has been described in connection with specific preferred embodiments, it should be understood that the invention as claimed should not be unduly limited to such specific embodiments.

For example, a single extension strap may be provided extending between the shoulder straps, possibly attached to a cross strap extending between the shoulder straps, to a detachable connection means provided at a dorsal location on the rear section of the harness. Also it is envisaged that releasable fastening means other than hook and loop fastening means might be utilised to releasably attach the lanyard connection member to the dorsal location and/or the one or more extension straps to the other portions of the harness. The various strap portions may be connected to the rear section of the harness such that the material of the rear section is load bearing or the strap portions (in particular the shoulder straps) may be continuous and extend over the length of the rear section.

The connection between the shoulder straps 4,5 and the respective side straps 8,9 may be provided by a ring or similar linking means to which the straps are connected.

Various modifications and variations to the described embodiment of the invention will be apparent to those skilled in the art without departing from the scope of the invention as defined in the appended claims. Although the invention has been described in connection with a specific preferred embodiment, it should be understood that the invention as claimed should not be unduly limited to such specific embodiment.

The invention claimed is:

1. A fall arrest harness for arresting the fall of a wearer of the harness working at height, the harness comprising:

a back portion configured to support an upper back region of a wearer and a seat portion configured to support a sub-pelvic region of the wearer;

a first shoulder strap and a second shoulder strap, wherein the first and second shoulder straps are each connected to the back portion and the seat portion;

a lanyard connection member disposed between the first and second shoulder straps, wherein the lanyard connection member is detachably connected to the back portion via first and second extension straps provided with a releasable material, the first and second extension straps including regions that overlie the back portion and wherein the fall arrest harness further comprises a cover member covering the regions of the first and second extension straps that overlie the back portion, the cover member being releasably secured to a rear portion of each of the first and second extension straps;

first and second leg straps connected to the seat portion; and a first side strap connected to the seat portion and extending between the seat portion and the first shoulder strap and a second side strap connected to the seat portion and extending between the seat portion and the second shoulder strap;

wherein each of the first and second extension straps is secured at a first end to a respective one of the first and second shoulder straps and at a second end to the lanyard connection member, wherein the first and second extension straps are configurable in a stowed position and an extended position, wherein the first and second extension straps are configured to extend over shoulders of the wearer proximate the back portion in the stowed position and release from the back portion in the extended position;

wherein the first and second extension straps are configured to extend, automatically, to the extended position when a tensile force is applied to the lanyard connection member that exceeds a predetermined threshold tensile force, wherein the lanyard connection member separates from the back portion and portions of the first and second extension straps separate from the shoulder straps so that the lanyard connection member detaches from the back portion and suspends the wearer in a supine position with a weight of the wearer being borne by the panel and being transferred to the lanyard connection member via the first and second shoulder straps and the first and second extension straps, wherein, when the first and second extension straps are in the extended position, the lanyard connection member is along an axis that intersects the seat portion, and the first and second shoulder straps are configured to be at least partially separated from the wearer via the first and second side straps.

2. The fall arrest harness according to claim 1, wherein the first and second extension straps comprises an energy absorbing material.

3. The fall arrest harness according to claim 2, wherein the energy absorbing material is irreversibly elongated when subjected to a tensile force that exceeds a predetermined threshold tensile force.

4. The fall arrest harness according to claim 1, wherein the first and second extension straps and the lanyard connection member are detachable from the back portion via a tearable stitching or a hook and loop fastening material.

5. The fall arrest harness according to claim 1, wherein the first extension strap extends from a sternal region of the first shoulder strap and is provided with a releasable fastener, such that the first extension strap is releasably secured in contact with the first shoulder strap, and the second extension strap extends from a sterna region of the second shoulder strap and is provided with a releasable fastener, such that the second extension strap is releasably secured in contact with the second shoulder strap, whereby the first and second extension straps are attached to the first and second shoulder straps in the stowed position, distal ends of the first and second extension straps being connected to the lanyard connection member.

6. The fall arrest harness according to claim 1, wherein the first leg strap extends between a first side region of the seat portion and a central region of the seat portion and the second leg strap extends between a second side region of the seat portion and the central region of the seat portion.

7. The fall arrest harness according to claim 1, wherein the seat portion comprises a pocket for receiving a foam seat panel or padding.

8. The fall arrest harness according to claim 7, wherein the seat panel comprises a rigid material.

9. The fall arrest harness according to claim 1, wherein the seat portion comprises fabric.

10. The fall arrest harness according to claim 1, wherein the cover member is secured to the rear portion of each of the first and second extension straps by a releasable fastener.

11. The fall arrest harness according to claim 10, wherein the releasable fastener comprises a tearable stitching, or a hook and loop fastener.

12. The fall arrest harness according to claim 1, wherein the lanyard connection member is releasably attached to the back portion by press stud fasteners.

13. The fall arrest harness of claim 1 wherein the cover member comprises a unitary member that is releasably secured to the first and second extension straps.

* * * * *